US005544967A

United States Patent [19]

Yao

[11] Patent Number: 5,544,967

[45] Date of Patent: Aug. 13, 1996

[54] MULTIPURPOSE PEN WITH ILLUMINATOR MEANS

[76] Inventor: Lu Yao, 9F, No. 190, Chi Lung Rd. Sec. 3, Taipei, Taiwan

[21] Appl. No.: 525,132

[22] Filed: Sep. 8, 1995

[51] Int. Cl.[6] ..... B43K 29/10

[52] U.S. Cl. ..... 401/195; 362/118; 401/52

[58] Field of Search ..... 401/52, 195; 362/118

[56] References Cited

U.S. PATENT DOCUMENTS

| | | | |
|---|---|---|---|
| 1,538,055 | 5/1925 | Olsen | 362/118 |
| 3,709,620 | 1/1973 | Miyamoto | 401/195 |
| 5,244,299 | 9/1993 | Chu | 401/195 |

FOREIGN PATENT DOCUMENTS

| | | | |
|---|---|---|---|
| 2273268 | 6/1994 | United Kingdom | 401/195 |

*Primary Examiner*—Steven A. Bratlie
*Attorney, Agent, or Firm*—Bacon & Thomas

[57] ABSTRACT

A pen including an upper barrel to hold a battery source, a lower barrel, a tip socket connected to the lower barrel at one end to hold a light source, a propelling mechanism fixedly mounted inside the lower barrel and turned by it to move a writing element in and out of the tip socket, a screw cap mounted on the upper barrel at the top and moved to control the electric circuit between the light source and the battery set, wherein a flashing circuit is mounted inside the upper barrel and connected to the light source by the writing element when the writing element is received inside the lower barrel, causing the light source to flash; a telescopic metal tube is connected to the inside of the lower barrel to hold the tip socket and moved to extend the tip socket away from the lower barrel when the pen is to be used as a pointer.

6 Claims, 8 Drawing Sheets

MULTIPURPOSE PEN WITH ILLUMINATOR MEANS

BACKGROUND OF THE INVENTION

The present invention relates to pens, and relates more particularly to a multipurpose pen which can be used as a signal light, a pointer, a flashlight, and a night stick for traffic policemen.

Various pen with light source means have been disclosed, and have appeared on the market. However, a pen with light source means can only be used for illuminating a limited area when the light source means is turned on because the length of the penholder is not adjustable and no light condensing means is available.

SUMMARY OF THE INVENTION

It is one object of the present invention to provide a multipurpose pen which has a light source controlled by a screw cap to give off light. It is another object of the present invention to provide a multipurpose pen which has a light condensing means for condensing light from the light source thereof. It is still another object of the present invention to provide a multipurpose pen which is installed with a telescopic tube to hold the tip socket to the penholder so that the length of the pen can be extended for allowing the pen to be used as a pointer, or a night stick for traffic policemen.

BRIEF DESCRIPTION OF THE DRAWINGS

FIG. 3B is similar to FIG. 3A but showing the writing element extended out of the metal tip socket and the light emitting diode turned on;

FIG. 4 is an elevational view of the pen, showing the telescopic metal tube extended out and the light emitting diode turned on;

DETAILED DESCRIPTION OF THE PREFERRED EMBODIMENT

Figure 1:
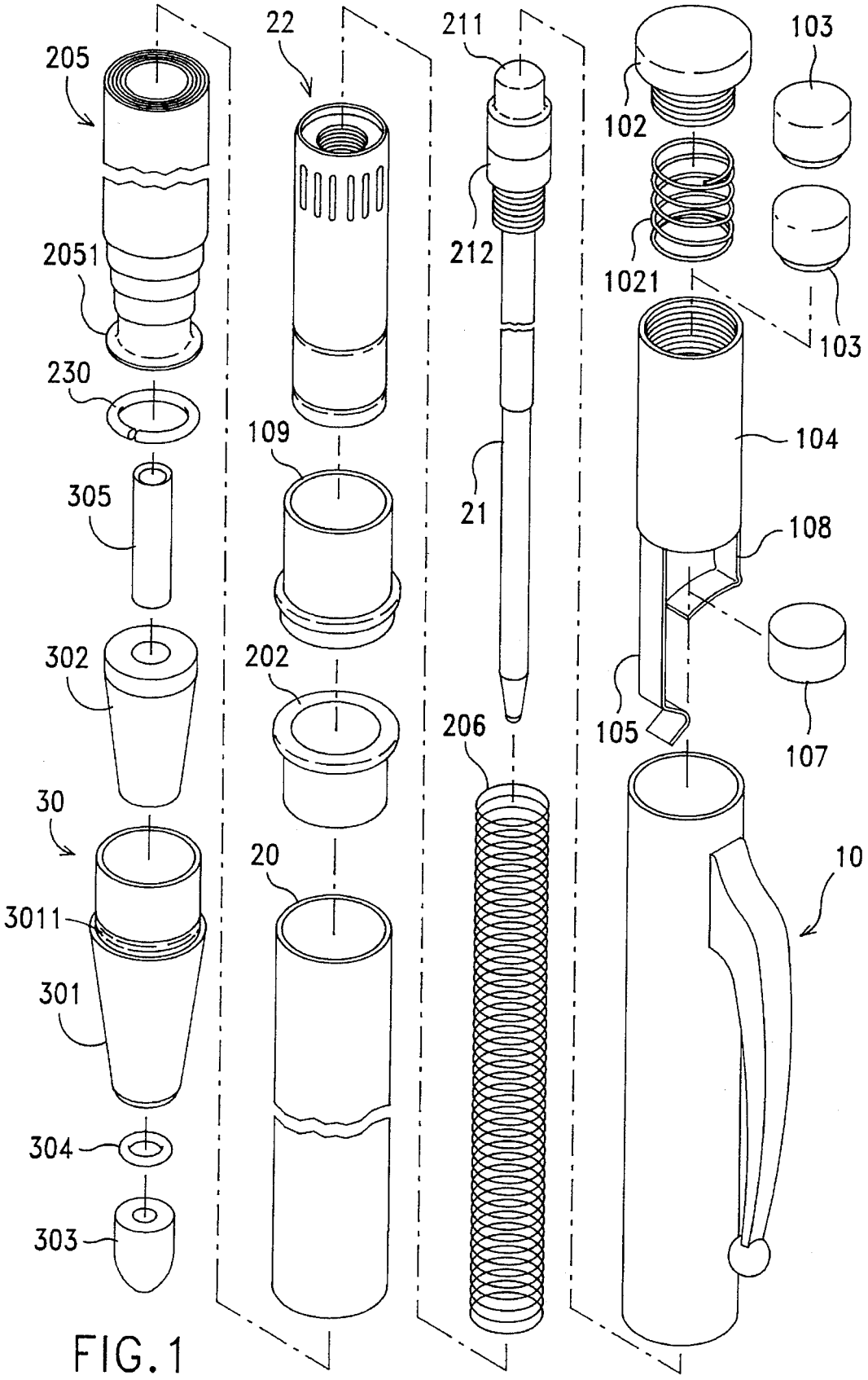
FIG. 1 is an exploded view of a pen according to the present invention.
Figure 2A:
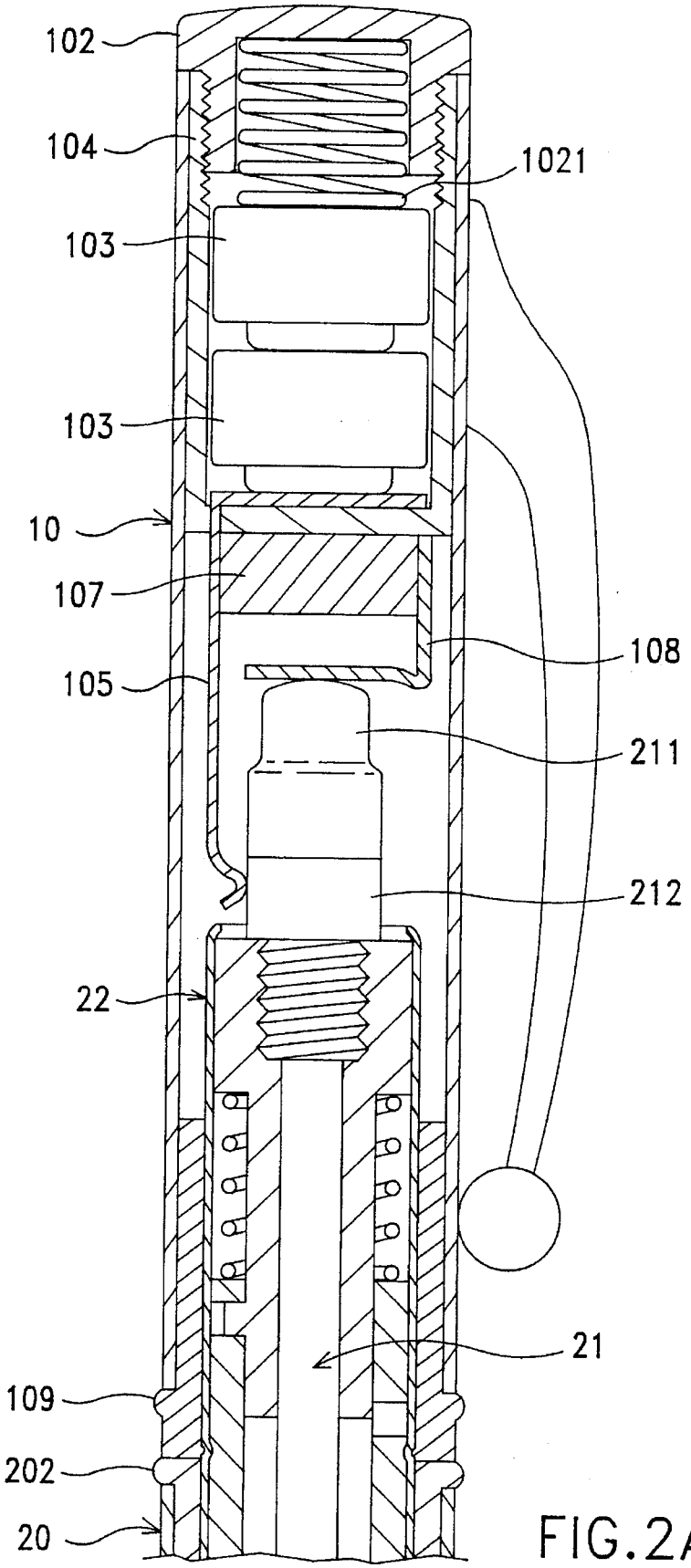
FIG. 2A is a sectional assembly view of the upper part of the pen shown in FIG. 1.
Figure 2B:
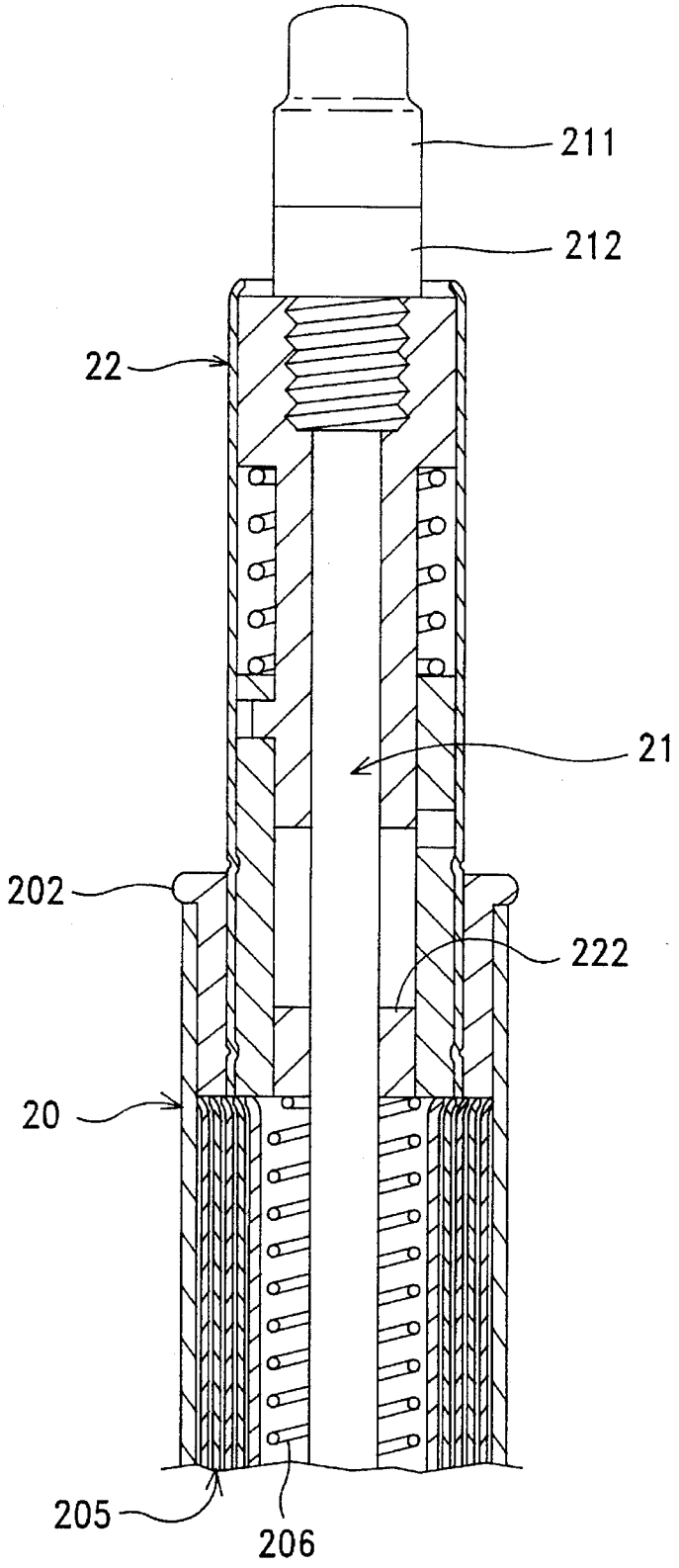
FIG. 2B is a sectional assembly view of the metal lower barrel, propelling mechanism and writing element of the pen shown in FIG. 1.
Figure 2C:
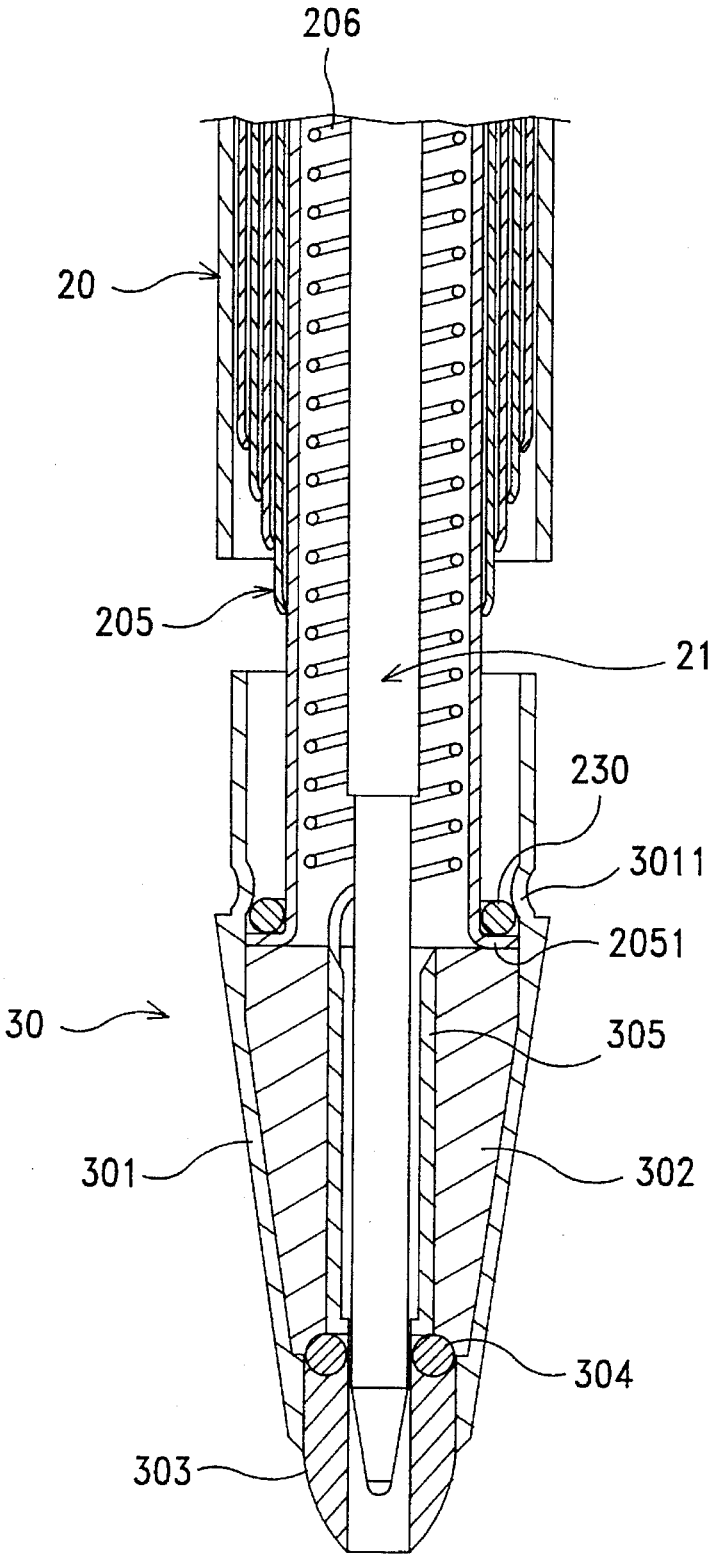
FIG. 2C is a sectional assembly view of the lower part of the pen shown in FIG. 1.

Referring to FIGS. 1, 2A, 2B, and 2C, a metal screw cap 102 is fastened to the top end of an insulative socket 104 inside a metal upper barrel 10. Battery cells 103 are mounted inside the insulative socket 104 and held down by a metal compression spring 1021. A metal lower barrel 20 is longitudinally connected to the metal upper barrel 10 at the bottom and rotated relative to the metal upper barrel 10. A propelling mechanism 22 is fixedly mounted inside the metal lower barrel 20 and turned by the metal lower barrel 20 to move a writing element (ink cartridge) 21 up and down. A metal tip socket 30 is fastened to the front end of the metal lower barrel 20 remote from the metal upper barrel 10. The metal tip socket 30 has a tapered front end 301, which holds a conical insulator 302 and a fiber head 303 in front of the conical insulator 302. The fiber head 303 is made from optical fibers. A first contact metal socket 109 is mounted inside the bottom end of the metal upper barrel 10. A second contact metal socket 202 is mounted inside the top end of the metal lower barrel 20. A first contact metal strip 105 and a second contact metal strip 108 are respectively extended downwards from the insulative socket 104. The first contact metal strip 105 is connected to the negative terminal of the battery cells 103. The second contact metal strip 108 is connected to a flashing circuit 107 inside the metal upper barrel 10 (see FIG. 2A). A telescopic metal tube 205 is mounted inside the metal lower barrel 20 and fixedly connected to the bottom end of the propelling mechanism 22, having a front end terminating in an outward flange 2051. The outward flange 2051 of the telescopic metal tube 205 is inserted into the metal tip socket 30 and fastened to an annular dent 3011 on the metal tip socket 30 by a packing expander 230 (see FIG. 2C). A spiral metal spring 206 is mounted around the writing element 21 within the telescopic metal tube 205, having one end connected to a metal ring 222 inside the propelling mechanism 22 and an opposite end connected to a copper tube 305 inside the conical insulator 302 (see FIGS. 2B and 2C). An annular light emitting diode 304 is mounted inside the metal tip socket 30 between the fiber head 303 and the conical insulator 302, and connected between the conical front end 301 of the metal tip socket 30 and the copper tube 305.

Figure 3A:
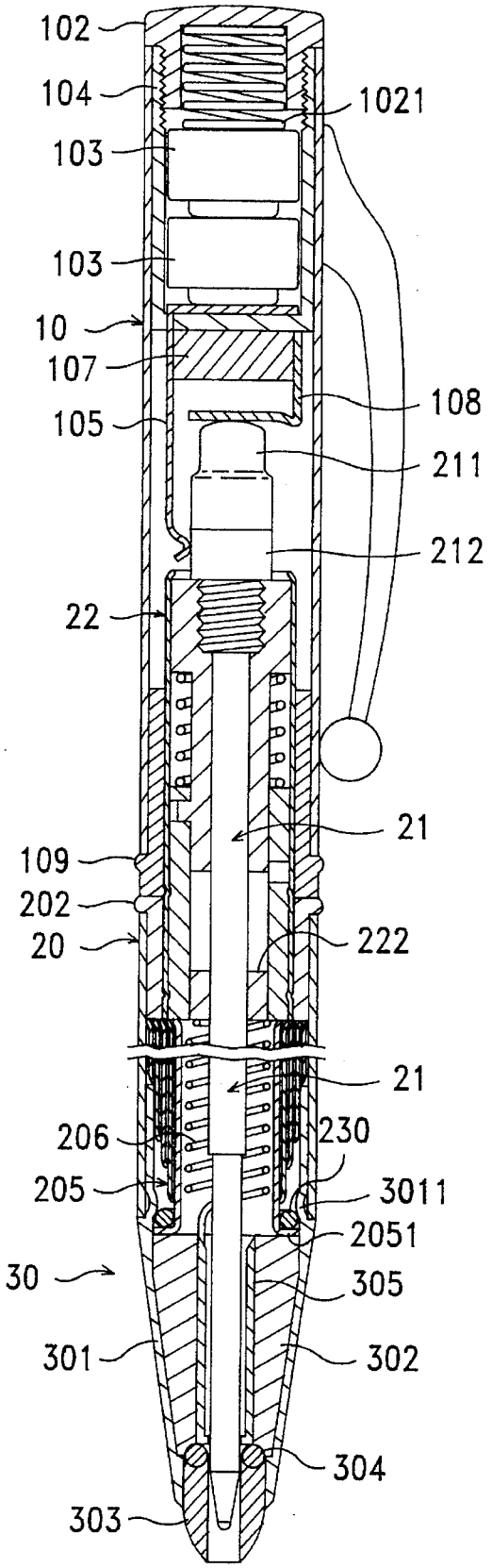
FIG. 3A is a longitudinal view in section of the pen shown in FIG. 1, showing the writing element received inside the metal tip socket.
Figure 3B:
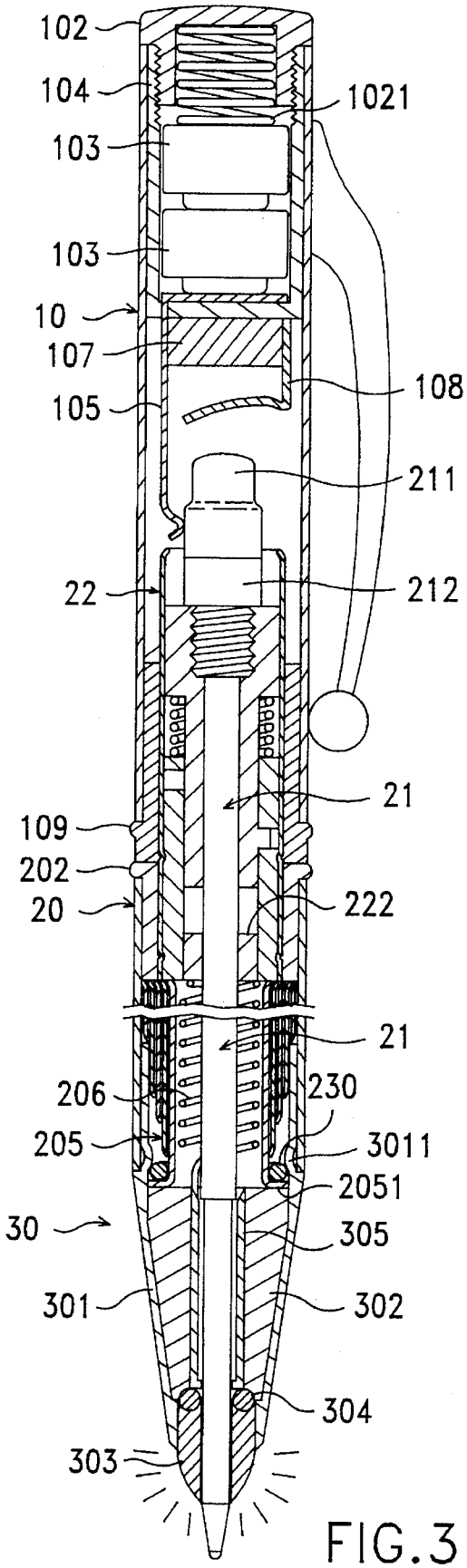
Figure 4:
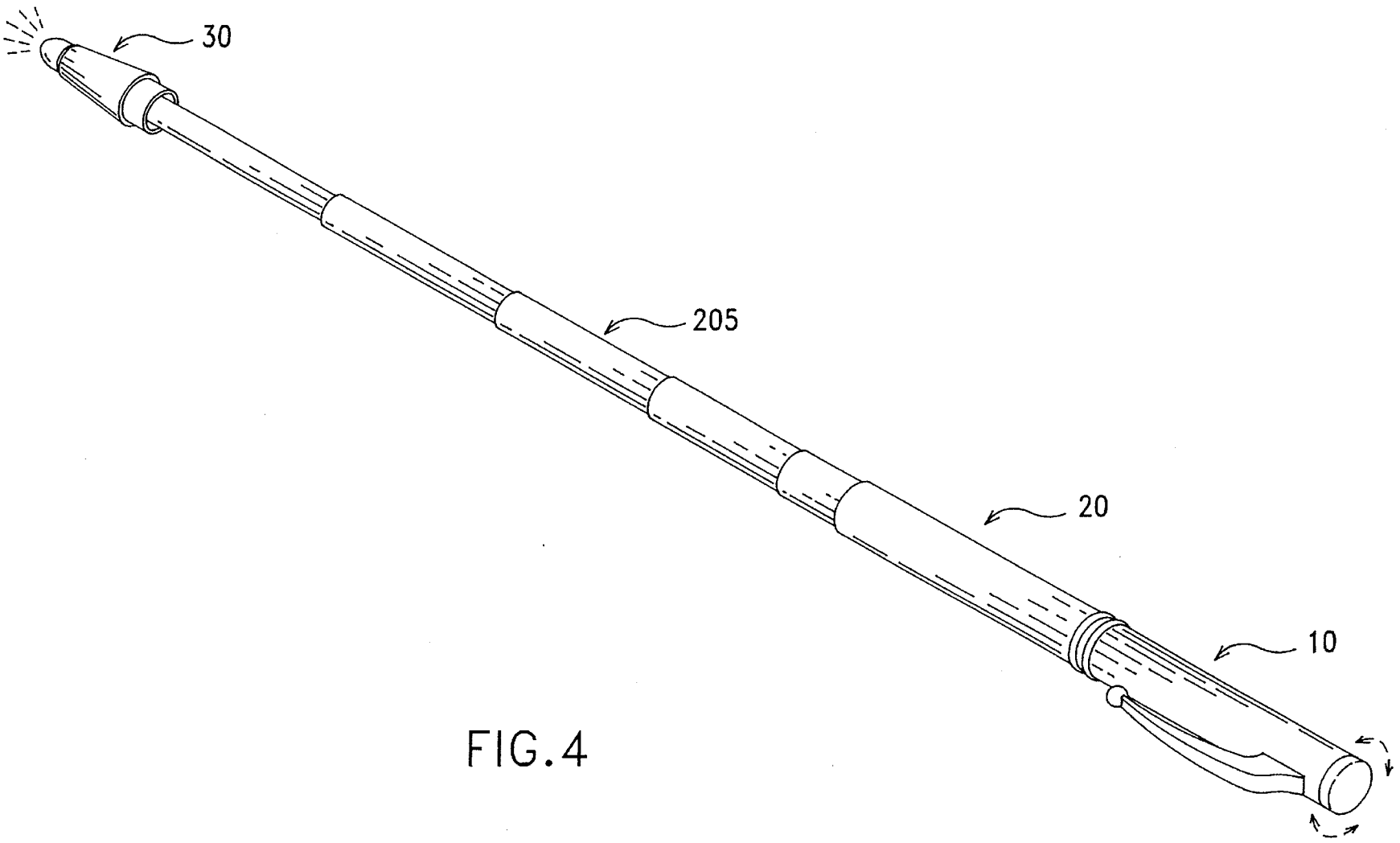

Referring to FIGS. 3A and 3B, the writing element 21 has a contact metal tip 211 at the top end disposed in contact with the second contact metal strip 108. When the metal screw cap 102 is screwed tight, the metal compression spring 1021 is disposed in contact with the positive terminal of the battery cells 103. Therefore, the positive terminal of the battery cells 103 is electrically connected to the metal compression spring 1021, the metal screw cap 102, the metal upper barrel 10, the first contact metal socket 109, the second contact metal socket 202, the metal lower barrel 20, the conical front end 301 of the metal tip socket 30. At the same time, the first contact metal strip 105 which is connected to the negative terminal of the battery cells 103 is disposed in contact with an insulative ring 212 on the writing element 21. Therefore the light emitting diode 304 is driven to flash. When the metal screw cap 102 is loosened and disconnected from the metal upper barrel 10, the positive terminal of the battery cells 103 is disconnected from the light emitting diode 304, and therefore the light emitting diode 304 is turned off. When the metal screw cap 102 is screwed tight and the writing element 21 is moved out of the fiber head 303 by the propelling mechanism 22 (see FIG. 3B), the contact metal tip 211 of the writing element 21 is moved from the second contact metal strip 108 to the first contact metal strip 105. Therefore, the negative terminal of the battery cells 103 is electrically connected to the metal ring 222, the spiral metal spring 206, and the copper tube 305, causing the two opposite terminals of the battery cells 103 electrically connected to the light emitting diode 304, and therefore the light emitting diode 304 is turned on to give off light without flashing (see FIG. 3B). At the same time, the telescopic metal tube 205 can be fully extended out (see FIG. 4) so that the pen can be used in pointing things out on a map or guiding traffic at night.

Figure 5:
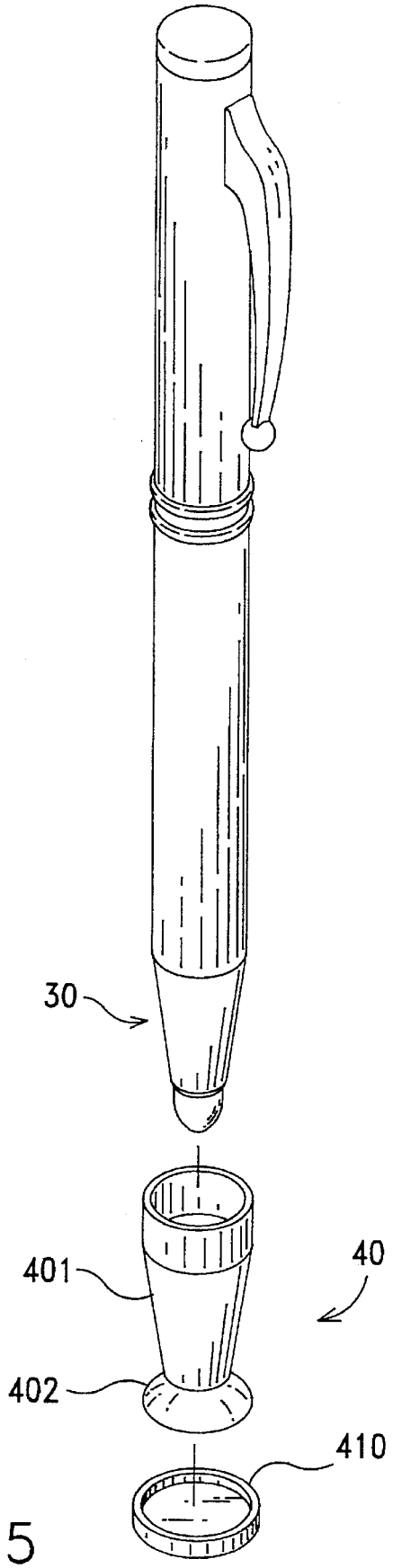
FIG. 5 is an exploded view of the tip socket cover for the pen according to the present invention.
Figure 5A:
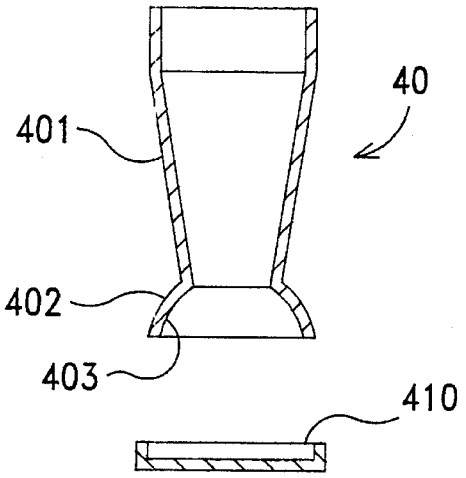
FIG. 5A is a sectional view of the tip socket cover shown in FIG. 5.
Figure 6:
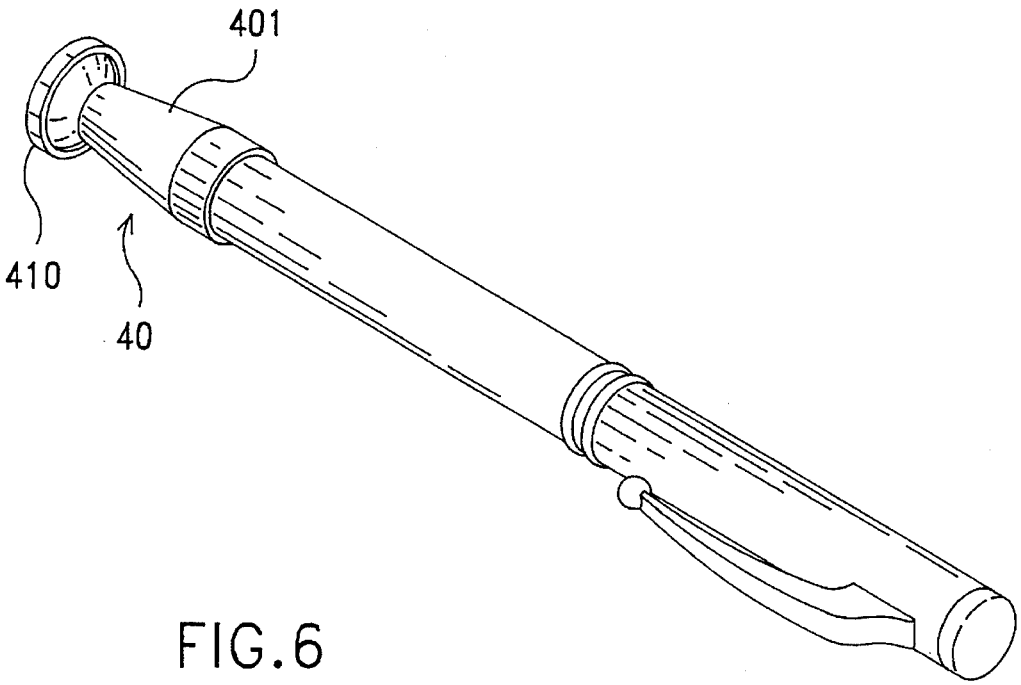
FIG. 6 shows the tip socket cover covered on the tip socket of the pen according to the present invention.
Figure 6A:
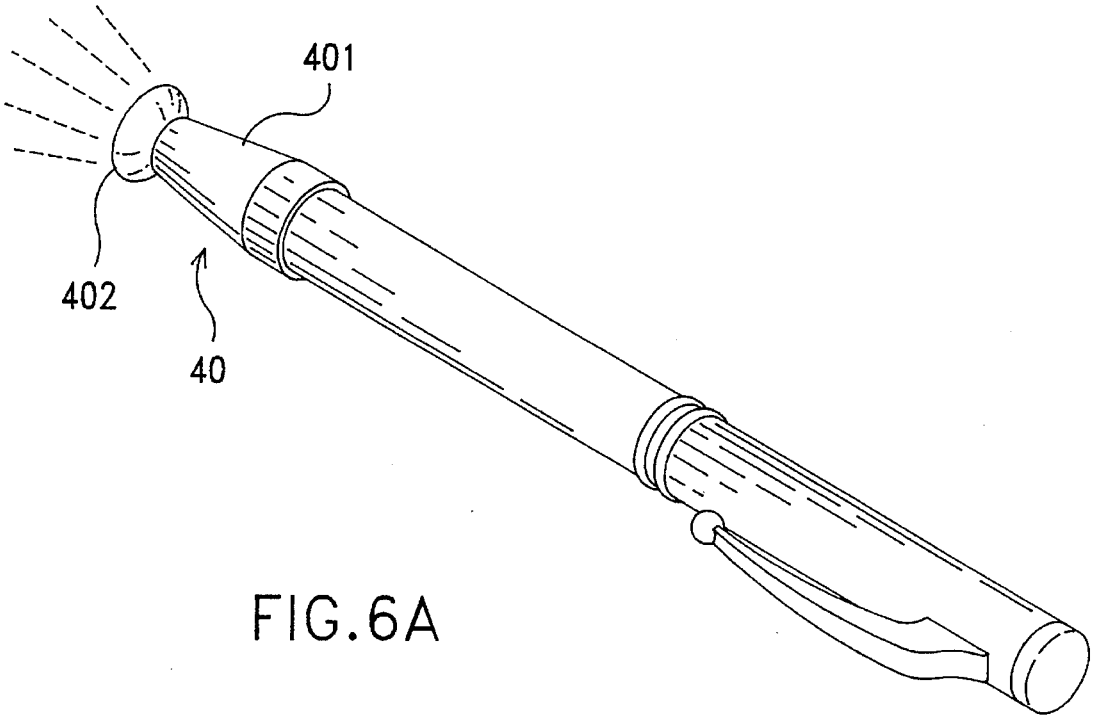
FIG. 6A is similar to FIG. 6 but showing the cap removed from the tip socket cover and light projected out of the tapered cylinder.

Referring to FIGS. 5, 5A, 6, and 6A, a tip socket cover 40 is provided for covering on the metal tip socket 30 over the fiber head 303. As illustrated in FIG. 5A, the cover 40 comprises a tapered cylinder 401 fitting over the metal tip socket 30, and a cap 410 covered on the tapered cylinder 401. The tapered cylinder 401 has one end terminating in a cup-like flange 402. The inside wall 403 of the cup-like flange 402 is covered thinly with silver by electrolysis for condensing light. When the pen is not in use, the tapered cylinder 401 is covered on the metal tip socket 30 and the cap 410 is fastened to the cup-like flange 402 of the tapered cylinder 401 to seal the tapered cylinder 401 (see FIG. 6). When the cap 410 is removed from the tapered cylinder 401, the pen can be used as a flashlight (see FIG. 6A).

It is to be understood that the drawings are designed for purposes of illustration only, and are not intended as a definition of the limits and scope of the invention disclosed.

I claim:

1. A pen of the type comprising:

a metal upper barrel having a top end and a bottom end;

an insulative socket mounted inside said metal upper barrel;

a metal screw cap fastened to said insulative socket above the top end of said metal upper barrel and moved between a first position in contact with said metal upper barrel and a second position disconnected from said metal upper barrel;

a battery set mounted inside said insulative socket;

a metal compression spring mounted within said insulative socket and connected between a positive terminal of said insulative socket and said metal screw cap;

a metal lower barrel having a top end connected to the bottom end of said metal upper barrel, and a bottom end;

a metal tip socket connected to the bottom end of said metal lower barrel;

a conical insulator mounted inside said metal tip socket to hold a copper tube on the inside;

a fiber head made from optical fibers and fixedly secured to said metal tip socket at one end remote from said metal lower barrel;

a conductive writing element mounted inside said metal lower barrel and inserted into said copper tube inside said conical insulator;

a conductive propelling mechanism fixedly mounted inside said metal lower barrel and turned by said metal lower barrel to move said writing element in and out of said fiber head;

a tip socket cover for covering on said metal tip socket over said fiber head;

a first contact metal socket fixedly mounted inside the bottom end of said metal upper barrel;

a second contact metal socket fixedly mounted inside the top end of said metal lower barrel and disposed in contact with said first contact metal socket and turned by said metal lower barrel relative to said first contact metal socket; and a light source mounted within said metal tip socket, said light source having one end connected to the positive terminal of said battery set through said metal tip socket, said metal lower barrel, said second contact metal socket, said first contact metal socket, said metal upper barrel, said metal screw cap, and said metal compression spring, and an opposite end connected to the negative terminal of said battery set;

the improvement comprising:

a flashing circuit mounted on said insulative socket inside said metal upper barrel and controlled to drive said light source, causing said light source to flash;

a first contact metal strip fixed to said insulative socket inside said metal upper barrel and connected to said flashing circuit;

a second contact metal strip fixed to said insulative socket inside said metal upper barrel and connected to the negative terminal of said battery set;

a telescopic metal tube mounted inside said metal lower barrel around said writing element, said telescopic metal tube having one end fixedly connected to said propelling mechanism and an opposite end fixedly connected to said metal tip socket and moved to extend said metal tip socket away from said metal lower barrel; and a wire conductor mounted around said writing element within said telescopic metal tube, having one end connected to said propelling mechanism and an opposite end connected to said copper tube inside said conical insulator;

wherein when said metal screw cap is moved to said first position in contact with said metal upper barrel and said writing element is moved inside said metal tip socket, said writing element is disposed in contact with said flashing circuit through said second contact metal strip, and said first contact metal strip is disposed in contact with an insulative ring on said writing element, and therefore said light source is electrically connected to said battery set through said flashing circuit and driven by said flashing circuit to flash; when said metal screw cap is moved to said first position in contact with said metal upper barrel and said writing element is extended out of said metal tip socket and said fiber head for writing, said writing element is disconnected from said second contact metal strip and disposed in contact with said first contact metal strip, and therefore said light source is electrically connected to give off light without flashing.

2. The pen of claim 1 wherein said wire conductor is a spiral spring.

3. The pen of claim 1 wherein said light source is a light emitting diode made of annular shape.

4. The pen of claim 3 wherein said light emitting diode is mounted within said metal tip socket and retained between said conical insulator and said fiber head, having one end connected to said metal tip socket and an opposite end connected to said copper tube.

5. The pen of claim 1 wherein said tip socket cover comprises a tapered cylinder fitting over said metal tip socket and having a cup-like flange at one end covered thinly with silver by electrolysis for condensing light from said light source.

6. The pen of claim 5 wherein said tip socket cover further comprises a cap for covering on said cup-like flange.

* * * * *